US010113522B2

(12) United States Patent
Asahi

(10) Patent No.: US 10,113,522 B2
(45) Date of Patent: Oct. 30, 2018

(54) END SEAL STRUCTURE OF A FUEL RAIL FOR A GASOLINE DIRECT INJECTION ENGINE

(71) Applicant: USUI KOKUSAI SANGYO KAISHA LIMITED, Shimizu-cho, Sunto-gun, Shizuoka (JP)

(72) Inventor: Daisuke Asahi, Shimizu-cho (JP)

(73) Assignee: USUI KOKUSAI SANGYO KAISHA LTD. (JP)

( * ) Notice: Subject to any disclaimer, the term of this patent is extended or adjusted under 35 U.S.C. 154(b) by 0 days.

(21) Appl. No.: 15/318,505

(22) PCT Filed: Jul. 15, 2015

(86) PCT No.: PCT/JP2015/070294

§ 371 (c)(1),
(2) Date: Dec. 13, 2016

(87) PCT Pub. No.: WO2016/010079

PCT Pub. Date: Jan. 21, 2016

(65) Prior Publication Data

US 2017/0122278 A1 May 4, 2017

(30) Foreign Application Priority Data

Jul. 16, 2014 (JP) ..... 2014-145608

(51) Int. Cl.
*F02M 55/00* (2006.01)
*F02M 55/02* (2006.01)
(Continued)

(52) U.S. Cl.
CPC ..... *F02M 55/005* (2013.01); *F02M 55/02* (2013.01); *F02M 55/025* (2013.01);
(Continued)

(58) Field of Classification Search
CPC ..... F02M 55/005; F02M 55/025
(Continued)

(56) References Cited

U.S. PATENT DOCUMENTS 2,625,955 A 1/1953 Day
5,896,843 A * 4/1999 Lorraine ..... F02M 55/004 123/447

(Continued)

FOREIGN PATENT DOCUMENTS

JP 10-122454 5/1998
JP 2008-133817 6/2008

(Continued)

OTHER PUBLICATIONS

European Search Report dated May 29, 2017.
International Search Report dated Oct. 13, 2015.

*Primary Examiner* — Lindsay Low
*Assistant Examiner* — Yi-Kai Wang
(74) *Attorney, Agent, or Firm* — Gerald E. Hespos; Michael J. Porco; Matthew T. Hespos

(57) ABSTRACT

Provided is an end seal structure of a fuel rail for a gasoline direct injection engine, the end seal structure being characterized in that: a pressure receiving surface is formed on an inner wall surface of the end cap having the cap-nut shape, the pressure receiving surface defining a seat surface; a pressing surface is formed at an end of the rail body, the pressing surface defining a seat surface facing the pressure receiving surface; the end cap having the cap-nut shape and including the pressure receiving surface is screwed and fixed to the rail body; and the pressure receiving surface of the end cap is brought into pressure contact with the pressing surface of the rail body by an axial force created by tightening of the end cap having the cap-nut shape so as to seal the end of the rail body.

1 Claim, 2 Drawing Sheets

(51) Int. Cl.
*F02M 55/04* (2006.01)
*F02M 69/46* (2006.01)

(52) U.S. Cl.
CPC ..... *F02M 55/04* (2013.01); *F02M 69/465* (2013.01); *F02M 2200/85* (2013.01)

(58) Field of Classification Search
USPC ..... 123/294
See application file for complete search history.

(56) References Cited

U.S. PATENT DOCUMENTS

| | | | | |
|---|---|---|---|---|
| 6,139,284 | A * | 10/2000 | Streicher | F02M 63/0225 417/273 |
| 6,470,859 | B2 * | 10/2002 | Imura | F02M 55/04 123/447 |
| 2009/0139595 | A1 | 6/2009 | Kato et al. | |
| 2011/0023831 | A1 * | 2/2011 | Klesse | F02M 55/025 123/447 |
| 2011/0108005 | A1 | 5/2011 | Nishizawa et al. | |
| 2012/0038142 | A1 * | 2/2012 | Legrand | F02M 55/002 285/14 |
| 2012/0211209 | A1 | 8/2012 | Choi | |
| 2013/0056978 | A1 | 3/2013 | Swift | |

FOREIGN PATENT DOCUMENTS

| | | |
|---|---|---|
| JP | 2008-297947 | 12/2008 |
| JP | 2010-7651 | 1/2010 |
| JP | 2011-144768 | 7/2011 |

* cited by examiner

END SEAL STRUCTURE OF A FUEL RAIL FOR A GASOLINE DIRECT INJECTION ENGINE

BACKGROUND

1. Field of the Invention

The present invention relates to an end seal structure of a fuel rail (delivery pipe) for supplying high-pressure fuel, which is supplied from fuel booster pumps of electronic fuel injection-type automobile engines or the like, through a fuel injector (an injection nozzle) directly injecting the fuel into an engine cylinder. More specifically, the present invention relates to an end seal structure of a fuel rail for a gasoline direct injection engine configured to directly supply the fuel from the rail to the injector with an injection pressure in the order of 20 MPa to 70 MPa.

2. Description of the Related Art

Some exemplary fuel rails can be mentioned as the conventional fuel rails for gasoline direct injection engines of this type. For example, an exemplary fuel rail includes a main pipe and several branch pipes and is constructed and arranged such that through-holes for receiving each branch pipe are formed in an outer wall of the main pipe, each through-hole having an annular wall that projects toward the outside and inside of the main pipe, respectively, and each branch pipe being fixed to the annular wall. Another exemplary fuel rail is constructed and arranged such that a branch pipe is connected to a body, which is an accumulating vessel, directly or via a branch joint fitting (nipple). Still another exemplary fuel rail is constructed and arranged such that a socket for connection of an injector is directly attached to a rail body constituted by a tubular member such as a pipe. Further, other exemplary fuel rails may be mentioned as the fuel rail constructed and arranged such that the socket for connection of the injector is directly attached to the rail body constituted by the tubular body such as the pipe. For example, an exemplary fuel rail includes an injector holder and a fastening bracket that are directly attached to a rail body constituted by a tubular body such as a pipe to which high-pressure fuel is supplied from a high-pressure fuel pump (see Japanese Patent Laid-Open No. 2010-7651). Also, a high-pressure fuel delivery pipe for a direct injection engine includes a cylindrical body pipe into which pressurized fuel from a high-pressure fuel pump is supplied, a plurality of sockets to which fuel injection valves coupled to the body pipe and operable to be opened and closed by a control unit are coupled, and a plurality of mounting stays integrally fastened to the body pipe so as to attach the body pipe to the engine (see Japanese Patent Laid-Open No. 2011-144768).

However, the above-mentioned conventional fuel rails for gasoline direct injection engines have the following problems.

Specifically, in the above-mentioned various conventional fuel rails for gasoline direct injection engines, a rail body constituted by a tubular body such as a pipe is constructed and arranged such that an end or both ends thereof are closed, and its end rail structure is, for example as illustrated in FIGS. 3 and 4 by enlarged views, generally configured such that end caps 112A and 112B are each joined by brazing to corresponding one of the ends of the openings of a cylindrical body pipe 111. Meanwhile, a problem that is identified and should be addressed is the strength of the end caps 112A and 112B closing the both ends of the body pipe 111 in the trends of higher pressures in gasoline direct injection systems. More specifically, the following and other problems are identified. In the case of the end seal structure configured by joining the end caps 112A and 112B by brazing to the body pipe 111 as illustrated in FIGS. 3 and 4, the end seal structure is configured such that, when an internal pressure is applied in the body pipe 111 which is the rail body, a force created in a radial direction of the rail body at the time of the body pipe 111 being deformed in the radial direction (swollen outward of the pipe) is received by the brazed portions 113A and 113B, respectively, so that these brazed portions 113A and 113B become the weakest portions in terms of their strength, which makes it difficult for gasoline direct injection systems to meet their higher-pressure requirements. Further, since the brazed portions 113A and 113B are in direct contact with the fuel (pressure medium), if there is any unevenness in the shape of these brazed portions, then it tends to become a factor of breakage of the brazed portions due to concentration of stress.

It is accordingly an aim of the present invention, which has been made in view of the problems found in the conventional fuel rails, to provide an end seal structure of a fuel rail for a gasoline direct injection engine, in particular in a rail body constituted by a tubular body such as a pipe constructed and arranged such that one end or both ends thereof are closed by an end cap or caps, having a simple structure and allowing the end cap portion to meet higher pressure requirements.

SUMMARY

An end seal structure of a fuel rail for a gasoline direct injection engine in accordance with the present invention employs a thread fastening mechanism in place of traditional braze mounting mechanism, and has the construction and arrangement in which a thread fastening section receives a force created in the radial direction of the rail body under application of an internal pressure to the rail body and the thread fastening section is not in contact with a fuel (pressure medium). The features of this end seal structure is characterized in that: in a fuel rail in which an end or both ends of a rail body thereof composed of a pipe is/are closed by an end cap or end caps, the end cap having a shape of a cap nut; a pressure receiving surface is formed on an inner wall surface of the end cap having the cap-nut shape, the pressure receiving surface defining a tapered seat surface; a pressing surface is formed at an end of the rail body, the pressing surface defining a spherical seat surface facing the pressure receiving surface; the end cap having the cap-nut shape and including the pressure receiving surface is screwed and fixed to the rail body; and the pressure receiving surface of the end cap is brought into pressure contact with the pressing surface of the rail body by an axial force created by tightening of the end cap having the cap-nut shape so as to seal the end of an opening of the rail body.

The end seal structure of the fuel rail for the gasoline direct injection engine in accordance with the present employs the thread fastening mechanism using the end cap having the cap-nut shape as a mounting mechanism to mount the end cap to the rail body, and employs the metal sealing mechanism between the rail body and the end cap having the cap-nut shape as a sealing mechanism, so that the pressure receiving surface formed on the inner wall surface of the end cap having the cap-nut shape is brought into pressure contact with the pressing surface of the rail body by the axial force created by tightening of the end cap having the cap-nut shape that is screwed and fixed to the rail body so as to seal the end of the rail body. With the configuration, the end seal structure of the invention has the following advantageous effects: since the force created at the time of the rail body being deformed in the radial direction (swollen outward of the pipe) under application of an internal pressure to the rail body is received by the thread fastening section and thus the thread fastening section acts as a compressive stress against the deformation of the rail body at the time of application of the internal pressure, the end seal structure becomes advantageous in terms of resistance to fatigue failure and allows to sufficiently meet the higher pressure requirements of a system; since the thread fastening section is configured to be not in contact with the fuel (pressure medium), even when any unevenness exists in the shape of the thread fastening section, it does not act as a cause of breakage due to the concentration of stress; the metal seal mechanism makes it possible to ensure the stability and reliability of the seal at the end of the rail body; and when other components (such as injector socket, bracket, etc.) are brazed to the rail body, substitution of the atmosphere gas in the rail body proceeds smoothly in a furnace, making it possible to achieve good brazing quality.

DETAILED DESCRIPTION

A main pipe rail in accordance with the present invention is a main body of a fuel rail for gasoline direct injection engines, in which a fuel inlet pipe (not shown) is connected to one end or a wall surface of the main pipe rail, the fuel inlet pipe is connected by a piping (not shown) to a fuel tank (not shown), fuel of the fuel tank is transferred to the fuel inlet pipe through the piping and a fuel pump, made to flow from the fuel inlet pipe to the main pipe rail, and then injected from an injector (not shown) into a cylinder (not shown). The main pipe rail 1 includes a plurality of sockets (not shown) or the like in its circumferential wall portion, the socket being adapted to allow the injector to be connected thereto. By way of example, a four-cylinder engine and an in-line six-cylinder engine will be equipped with four sockets and six sockets, respectively, which are provided at desired intervals.

Figure 1:
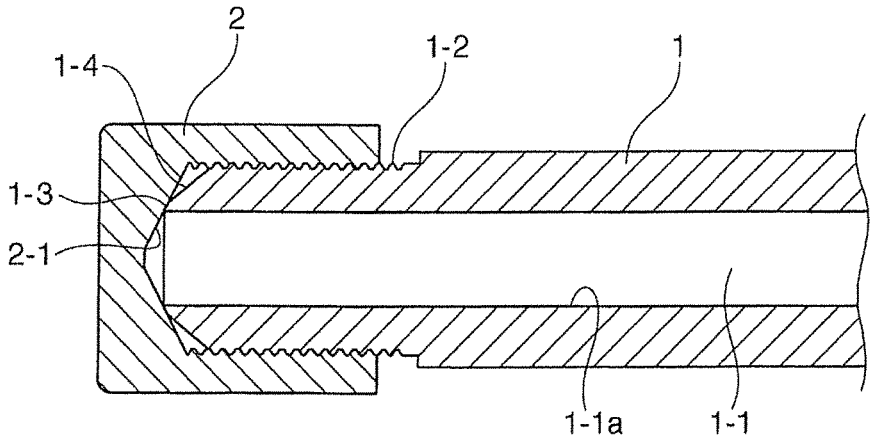
FIG. 1 is a cross-sectional view illustrating an end seal structure of a fuel rail for a gasoline direct injection engine in accordance with a first embodiment of the present invention.

In FIG. 1, a reference sign 1 denotes a rail body 1 and a reference sign 2 denotes an end cap 2 with a cap-nut shape. More specifically, in an end seal structure of a fuel rail for a gasoline direct injection engine in accordance with a first embodiment illustrated in FIG. 1, an external thread 1-2 is formed on an outer circumferential surface of an end of the pipe of the rail body 1 that has a cylindrical inner circumferential wall surface 1-1*a* defining a flow passage 1-1 therein, a tapered section 1-4 is provided at an end of the rail body continuing to the external thread 1-2 and a pressing surface 1-3 defining a spherical seat surface is positioned adjacent to the tapered section. Meanwhile, the end cap 2 having the cap-nut shape and fastened to the outer circumference of the end of the pipe of the rail body 1 includes a pressure receiving surface 2-1 defining a tapered seat surface on an inner wall surface which is a surface facing the pressing surface 1-3 of the rail body 1, the end cap 2 is screwed and attached to the external thread 1-2 formed at the end of the pipe of the rail body 1, and the pressing surface 1-3 provided on the rail body 1 is brought into pressure contact with the pressure receiving surface 2-1 of the end cap 2 having the cap-nut shape by the axial force created by tightening of the end cap 2 having the cap-nut shape and thereby the end of the rail body 1 is sealed.

According to the end seal structure of the fuel rail for the gasoline direct injection engine shown in FIG. 1, when the end cap 2 having the cap-nut shape threadedly attached to the end of the pipe of the rail body 1 is tightened, then the pressing surface 1-3 provided on the rail body 1 brings into pressure contact with the pressure receiving surface 2-1 provided on the end cap by the axial force created by the tightening of the end cap 2 having the cap-nut shape, the end of an opening of the rail body 1 is thus sealed as described above, and as a result, the thread fastening section of the end cap 2 having the cap-nut shape and the rail body 1 and the flow passage 1-1 of the rail body 1 are completely closed. Accordingly, according to this end seal structure of the fuel rail for the gasoline direct injection engine, the thread fastening section of the end cap 2 having the cap-nut shape acts as a compressive stress against deformation in the radial direction of the rail body 1 (swelling toward the outside of the pipe) which is created when an internal pressure acts upon the flow passage 1-1 of the rail body 1. As a result, the thread fastening section exhibits excellent characteristics in terms of resistance to fatigue failure and has the capability of accommodating itself to a higher internal pressure applied to the flow passage 1-1 of the rail body 1. Also, the thread fastening section of the end cap 2 having the cap-nut shape is constructed and arranged such that it does not contact the fuel (pressure medium) in the rail body 1. Accordingly, even if the shape of the thread fastening section has any unevenness, it never acts as a factor that leads to breakage due to concentration of stress. Moreover, the stability and reliability of the seal at the end of the rail body 1 are ensured thanks to the metal seal mechanism that the pressing surface 1-3 provided on the rail body 1 brings into pressure contact with the pressure receiving surface 2-1 provided on the end cap by the axial force created by tightening of the end cap 2 having the cap-nut shape and thereby the end of the rail body 1 is sealed.

Figure 2:
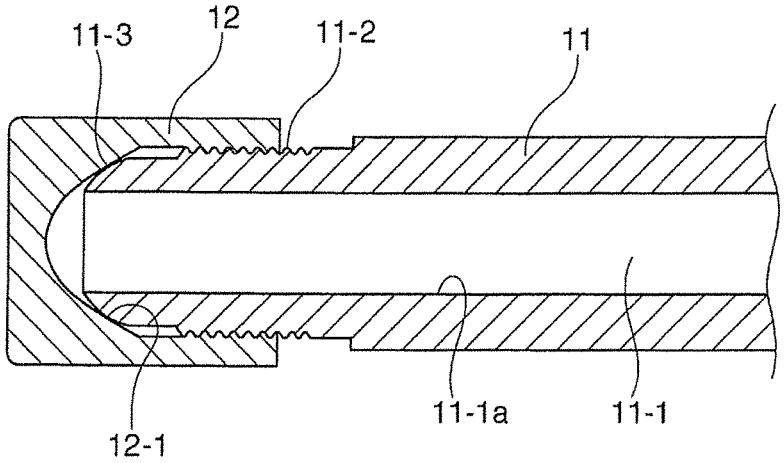
FIG. 2 is a cross-sectional view illustrating an end seal structure in accordance with a second embodiment of the present invention.
Figure 3:
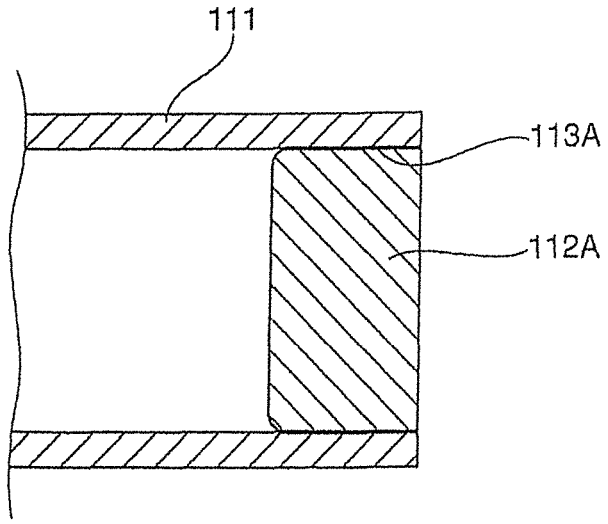
Fig. 3 PRIOR ART
FIG. 3 is a cross-sectional view illustrating an example of a conventional end seal structure of a fuel rail for a gasoline direct injection engine.
Figure 4:
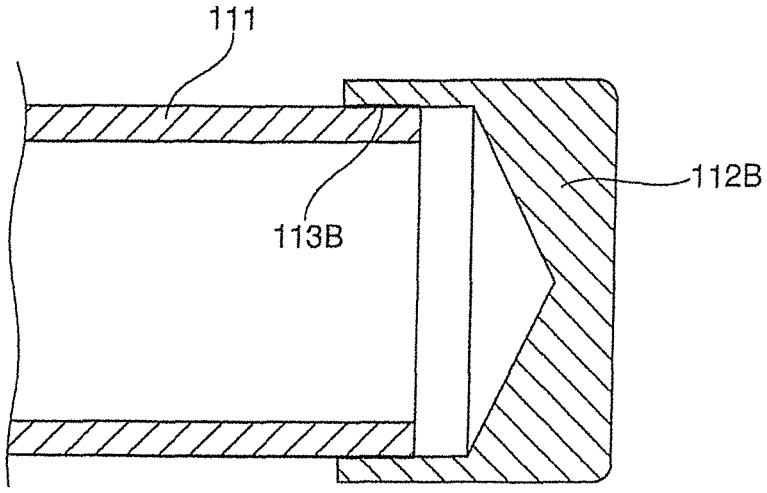
Fig. 4 PRIOR ART
FIG. 4 is a cross-sectional view illustrating another example of a conventional end seal structure of a fuel rail for a gasoline direct injection engine.

An end seal structure of a fuel rail for a gasoline direct injection engine in accordance with a second embodiment shown in FIG. 2 has the same structure as the end seal structure of the fuel rail for the gasoline direct injection engine in accordance with the first embodiment shown in FIG. 1 except that the pressing surface provided on the rail body takes a large spherical shape without the tapered section. Specifically, a pressing surface 11-3 having a spherical seat surface is formed at an end of the rail body continuing to the external thread 11-2 formed on the outer circumference of the pipe of the rail body 11 that has a cylindrical inner circumferential wall surface 11-1*a* defining a flow passage 11-1 therein, a pressure receiving surface 12-1 having a tapered seat surface is formed on an inner wall surface which is a surface facing the pressing surface 11-3 of the end cap 12 having the cap-nut shape screwed and fixed to an outer circumference of the end of the pipe of this rail body 11, so that the pressing surface 11-3 provided on the rail body 11 brings into pressure contact with the pressure receiving surface 12-1 provided on the end cap 12 having the cap-nut shape by the axial force created by tightening of the end cap 12 having the cap-nut shape, which is screwed and fixed to the external thread 11-2 formed at the end of the pipe of the rail body 11, and thereby the end of the rail body 11 is sealed.

Also in the end seal structure of the fuel rail for the gasoline direct injection engine illustrated in FIG. 2, similarly to the end seal structure shown in FIG. 1, when the end cap 12 having the cap-nut shape threadedly attached to the end of the rail body 11 is tightened, the pressing surface 11-3 provided on the rail body 11 brings into pressure contact with the pressure receiving surface 12-1 provided on the end cap by the axial force created by the tightening of the end cap 12 having the cap-nut shape, thereby the end of the opening of the rail body 11 is sealed as described above, and as a result, the thread fastening section of the end cap 12 having the cap-nut shape and the rail body 11, and the flow passage 11-1 of the rail body 11 are completely closed. Accordingly, also in the case of this end seal structure of the fuel rail for the gasoline direct injection engine, the thread fastening section of the end cap 12 having the cap-nut shape acts as a compressive stress against deformation in the radial direction of the rail body 11 (swelling toward the outside of the pipe) which is created when an internal pressure acts upon the flow passage 11-1 of the rail body 11. As a result, the thread fastening section exhibits excellent characteristics in terms of resistance to fatigue failure and has the capability of accommodating itself to a higher internal pressure applied to the flow passage 11-1 of the rail body 11. Also, the thread fastening section of the end cap 12 having the cap-nut shape is constructed and arranged such that it does not contact the fuel (pressure medium) in the rail body 11. Accordingly, in this embodiment as well, even if the shape of the thread fastening section of the end cap 12 having the cap-nut shape has any unevenness, it never acts as a factor that leads to breakage due to concentration of stress. Moreover, the stability and reliability of the seal at the end of the rail body 11 are ensured thanks to the metal seal mechanism that the pressing surface 11-3 provided on the rail body 11 brings into pressure contact with the pressure receiving surface 12-1 provided on the end cap by the axial force created by tightening of the end cap 12 having the cap-nut shape and thereby the end of the rail body 11 is sealed.

REFERENCE SIGNS LIST

1, 11 Rail body
1-1, 11-1 Flow passage
1-1*a*, 11-1*a* Inner circumferential wall surface
1-2, 11-2 External thread
1-3, 11-3: Pressing surface
1-4: Tapered section
2, 12: End cap having a cap-nut shape
2-1, 12-1 Pressure receiving surface

The invention claimed is:

1. An end seal structure of a fuel rail for a gasoline direct injection engine, comprising:

a rail body composed of a pipe having a pressing surface formed at least at one end of the rail body and defining a spherical seat surface, and external threads formed on the rail body; and an end cap that has a cap-nut shape with a closed end, an open end and an inner wall surface extending from the open end to the closed end, internal threads formed in the inner wall surface, and a pressure receiving surface formed on the inner wall surface of the end cap, the pressure receiving surface defining a concave tapered seat surface and being disposed so that the internal threads are between pressure receiving surface and the open end of the end cap; wherein the end cap is screwed and fixed to the rail body so that the concave tapered pressure receiving surface of the end cap is brought into pressure contact with the spherical pressing surface of the rail body by an axial force created by tightening the internal threads of the end cap to the external threads of the rail body to seal the end of an opening of the rail body.

* * * * *